United States Patent [19]

Luitje

[11] Patent Number: 4,708,491

[45] Date of Patent: Nov. 24, 1987

[54] TIME OF DAY CLOCK

[75] Inventor: William V. Luitje, Ann Arbor, Mich.

[73] Assignee: Chrysler Motors Corporation, Highland Park, Mich.

[21] Appl. No.: 54,646

[22] Filed: May 27, 1987

[51] Int. Cl.[4] ..... G04C 13/08

[52] U.S. Cl. ..... 368/156; 368/200

[58] Field of Search ..... 368/155–156, 368/200–202; 331/47, 66, 176; 364/569

[56] References Cited

U.S. PATENT DOCUMENTS 4,282,595 8/1981 Lowdenslager et al. ..... 368/200

4,400,093 8/1983 Jaunin ..... 368/200

4,407,589 10/1983 Davidson et al. ..... 368/200

4,513,259 4/1985 Frerking ..... 368/202

*Primary Examiner*—Vit W. Miska

*Attorney, Agent, or Firm*—Wendell K. Fredericks

[57] ABSTRACT

A fundamental interval of time is derived from a clock signal of an inherent frequency emanating from an untrimmed crystal oscillator. Firmware and hardware of the time-of-day clock system are used to control and modify the time interval between interrupt signals generated upon the occurrence of a specified count of clock cycles of the clock signals emanating from the crystal oscillator.

6 Claims, 2 Drawing Figures

TIME OF DAY CLOCK

BACKGROUND OF THE INVENTION

1. Field of the Invention

The present invention relates generally to time of day clock systems employing crystal oscillators for providing reference frequencies from which time periods are derived, and more particularly, to improved time of day clocks and crystal oscillator control techniques therefor which minimize errors in adjusting the output frequency of the oscillators.

2. Description of the Prior Art

In prior art time-of-day clock systems, it is well-known to use a crystal input to control the internal oscillator of a microcomputer. The internal oscillator in most microcomputers is designed to interface with a parallel resonant quartz crystal of a specified frequency. A crystal pi network is connected between the internal oscillator and the crystal. The pi network usually has a variable capacitor which is used to vary the tuning range of the oscillator.

To accurately adjust the oscillator's output frequency to a desired rate for use in the microcomputer (e.g., 8 MHz), the variable capacitor is used as a trimmer capacitor to vary the frequency range of the oscillator while a suitable frequency calibration meter is used to monitor the changes in frequency as the anti-resonance of the crystal is changed. Once the trimming of the oscillator is completed, usually a sealant is used to affix the trimmer capacitor's sealant in place. But sometimes, the very act of affixing the sealant causes the adjustment to move from its optimum position. Once the capacitors are sealed and the oscillator is properly trimmed, the accuracy of the oscillator may still be affected because typical trimmer capacitors usually are susceptible to variations in environmental conditions such as humidity and temperature.

Another technique for adjusting the frequency output of the oscillator is to use digital correction techniques such as those described in U.S. Pat. No. 4,282,595, by Lowdenslager et al. entitled "Method For Digital Frequency Trimming an Oscillator in an Electronic Timepiece." There, the effective frequency of an oscillator in a watch is adjusted by periodically inhibiting pulses to a divider stage. A pulse inhibit circuit includes a nonvolatile programmable ROM for storing binary complement information corresponding to the number of oscillator pulses needed to be suppressed to achieve the effective frequency. A counter is periodically preset with the binary complement information and the count advances in response to the oscillator's pulses. The difference count between the complement number and the counter's maximum count controls the number of pulses periodically suppressed. During the manufacture and assembly of the watch, the ROM is programmed to contain the desired complement information.

This technique does permit effective trimming of the oscillator's frequency; however, the correction procedures can only make the oscillator slower. There must be a guarantee that the uncorrected oscillator frequency is of a rate greater than the effective frequency needed for the watch.

In motor vehicles equipped with digital computers, along with vehicle electronics and instrumentation which provides visual displays of a variety of information related to the condition and operation of the motor vehicle, a time-of-day clock is usually provided. The time-of-day clock must be capable of displaying minutes, hours, days of the week, days of the month and months accurately to at least 80 seconds per month (i.e., 0.003%). This is a fairly loose specification due to the extreme environmental conditions the time-of-day clock experiences in an automobile. However, to meet at least this specification, any software programming needed to program the system's computers should not contribute to timing inaccuracies.

Crystals used in crystal oscillators typically having an accuracy of about ±0.01% which, if not adjusted, will result in errors of about nine seconds a day and nearly five minutes a month which is too much error to meet the above-mentioned loose specification.

Hence, in developing a time-of-day clock with improved accuracy, it is desirable to minimize errors when adjusting the output frequency of the oscillator in the microcomputer being used. It is also desirable to perform the adjusting with automated equipment, without sacrificing effectiveness and to employ as few additional hardware components as necessary. Also, it is desirable that the timing circuitry is not susceptible to environmental conditions such as humidity and temperature and to mechanical vibrations of the motor vehicle.

To obtain the above-mentioned desiderata, a search for various other ways to calibrate crystal oscillators was initiated. This search resulted in the improved apparatus and techniques of the present invention.

SUMMARY OF THE INVENTION

As a solution to these and other problems, the present invention comprises a time-of-day clock system having a time base that is automatically adjusted by firmware in a computer and is free from the defects of the prior art. More particularly, the invention comprises a microcomputer that has a timer system that is controlled by a crystal oscillator. The crystal in this oscillator is one that is not manufactured to a final and accurate predetermined frequency, nor is it trimmed to a predetermined anti-resonance frequency. The timer system in the microcomputer is one in which all timing functions are related to a 16-bit free running counter. The free running counter is clocked by the output of the oscillator after the frequency of the oscillator is divided down by a prescaler circuit a predetermined amount, e.g., an 8 MHz frequency clock signal is divided by four so that the oscillator's clock signal to the free-running counter is 2 MHz. A suitable frequency calibration meter is connected to the output of the prescaler in order to measure the value of the inherent frequency of the divided-down clock frequency. This measured inherent frequency value is digitized and transferred via an input-output port and stored in an EEPROM of the microcomputer and is used for computing a "finely tuned" correction term, the correction term being computed by taking the plus or minus difference between a desired or effective frequency needed for this time-of-day clock arrangement and the measured inherent frequency. A predetermined free running counter control term, another digital number value, is factory installed in ROM which is used by an output compare register within the timing system to generate an interrupt signal every 1/32 of a second. An interrupt counter in RAM is incremented each time an interrupt signal occurs. Upon counting 32 interrupts, a "second" counter is incremented. After counting the initial 32 interrupts, the correction term stored in EEPROM is used to finely tune the fundamental unit of time employed for generating the signal used to increment a 60-second ccunter. Further, RAM counters are incremented to accumulate accurate minutes, hours, days and months intervals.

BRIEF DESCRIPTION OF THE DRAWING

Referring to the drawing figures in which like numerals represent like parts in the several views.

DETAILED DESCRIPTION OF A PREFERRED EMBODIMENT

Figure 1:
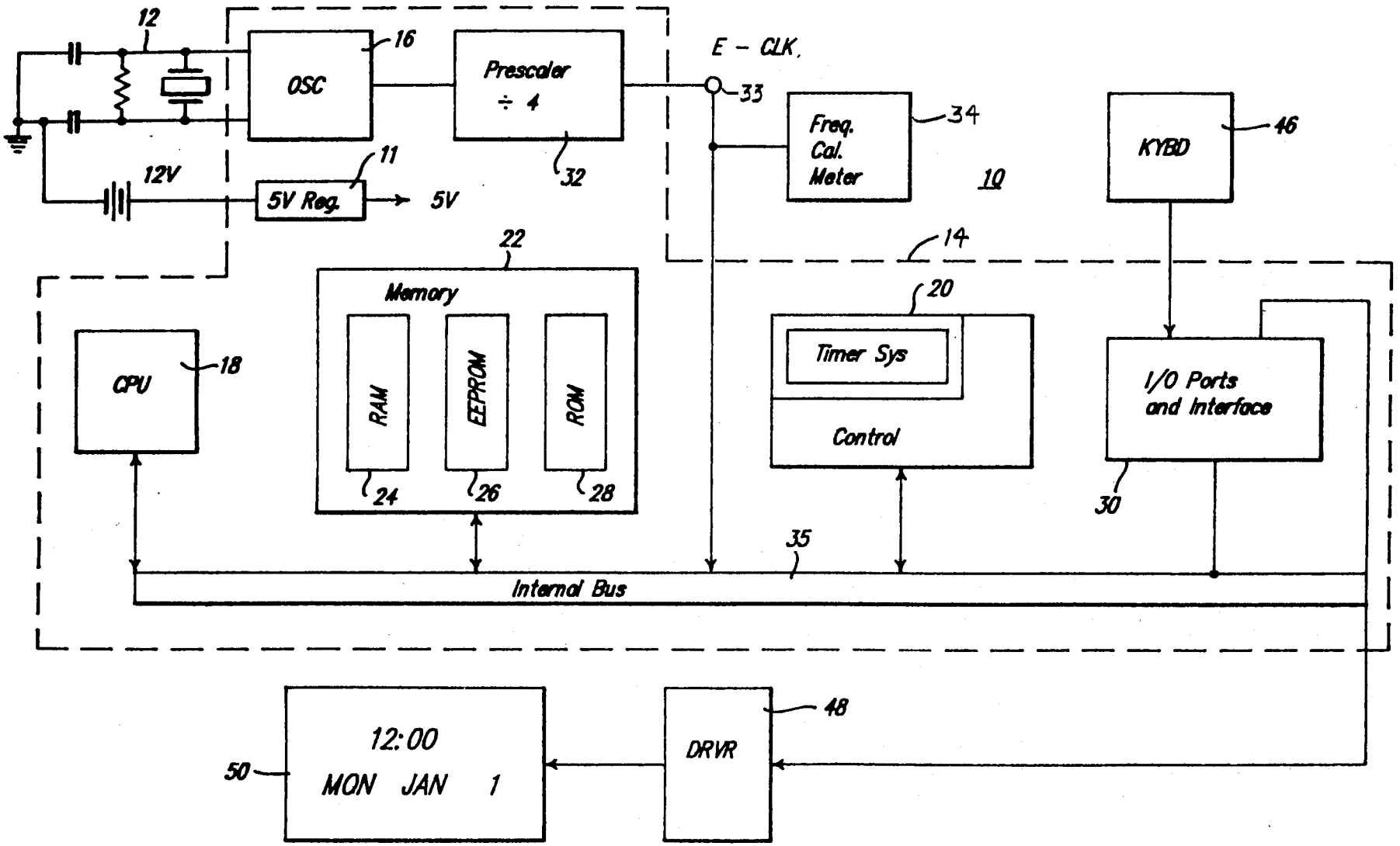
FIG. 1 is a block diagram of a time-of-day clock system in accordance with an embodiment of the present invention.

FIG. 1 is a block diagram of a preferred embodiment of a time-of-day system 10. System 10 may be employed, e.g., in an instrument panel of a motor vehicle equipped with vehicle electronics and instrumentation to provide visual displays of a variety of information related to the condition and operation of the motor vehicle. The operator often has a need to know the time of day, the day, the week, as well as the month.

An untrimmed quartz crystal 12 that oscillates at an inherent resonance, illustratively, about 8 MHz is coupled to an internal oscillator 16 of a microcomputer MCU 14, such as a Motorola Microcomputer Device No. M68HC11. MCU 14 contains a microprocessor (CPU) 18; a timer system 20; a memory 22 that includes RAM 24, EEPROM 26, and ROM 28; input/output (I/O) ports 30 and a prescaler circuit 32.

The prescaler circuit 32 which is connected directly to an output of oscillator 16 divides the incoming 8 MHz oscillator frequency from oscillator 16 by, e.g., 4 to establish a scaled down inherent frequency of about 2 MHz.

In order to determine precisely the error between the inherent oscillator frequency and the desired oscillator frequency for clocking the time-of-day clock, a suitable frequency calibration meter 34, such as a Tektronix Digital Counter, Device No. 5010 is used. Meter 34 is connected to system 10 at an E-CLK terminal 33. After obtaining a measure of the error, that error value is stored in EEPROM 26 via keyboard 46 as a correction term, the use of it to be explained infra. After obtaining and storing the correction term, meter 34 is no longer needed and is disconnected and removed from the system. Meter 34 may be used later for modifying the correction term in response to aging or drifting of the crystal and oscillator components.

Figure 2:
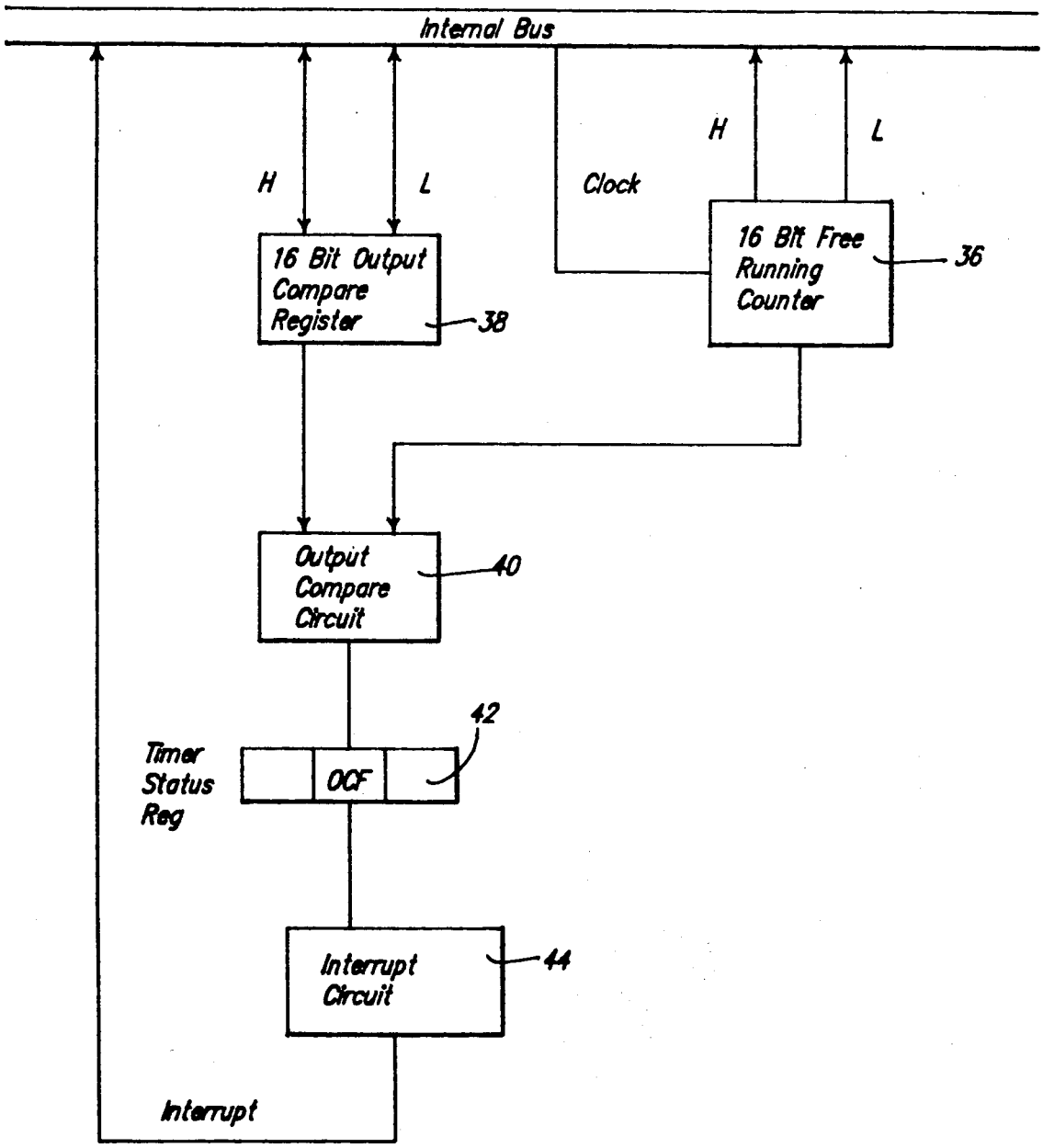
FIG. 2 is a block diagram of a portion of a timer system within the time-of-day clock system of FIG. 1 used to generate the interrupt signal and for inserting the correction term used to finely tune the fundamental unit of time employed in this invention's clock.

The inherent oscillator frequency signal at E-CLK terminal 33 is routed to the timer system 20 depicted in FIG. 2. Timer system 20 is used in this embodiment to generate a series of 1/32-second interrupt signals which form the fundamental time units for the time-of-day clock. As mentioned supra, the prescaler circuit 32 divides down the inherent oscillator frequency to about 2.0 MHz. By doing so, the prescaler circuit provides at the input of timer system 20 a frequency resolution of nearly 0.5 microseconds.

In order to form 1/32-second interrupts, a 16-bit, free running counter 36 within timer system 20 is clocked by the 2.0 MHz clock signal from prescaler circuit 32. A. programmable output compare register 38 also within timer system 20 is used in combination with the free-running counter 36 to generate intervals of approximately 1/32 of a second. These intervals are approximate because the output frequency of oscillator 16 is not exactly 2 MHz. To generate these intervals, a control term, having a value of 62500 formed by dividing 2 MHz by 32 which is factory stored in ROM 28 is added to the output compare register 38 before each interrupt signal is generated. The contents of the output compare register are compared with the contents of the free running counter by an output compare circuit 40. When a match is found, an output compare flag (OCF) bit from a timer status register 42 is set by an output signal from circuit 40. OCF causes interrupt circuit 46 to generate an interrupt signal which causes CPU 18 to execute a software interrupt service program. This interrupt service program prepares the timer system 20 for the next interrupt by adding the control term to new contents of the output compare register. It then increments an interrupt counter in RAM 24.

When after the interrupt counter in RAM 24 counts 32 such interrupts, which will initially approximate a one-second interval, the software interrupt service program adds the correction term (e.g., a digital value of 713) to the output compare register 38. By adding the correction term at this time, after counting the initial 32 interrupts, any error in timekeeping for the previous one-second is corrected. From this point henceforth, the fundamental time intervals of each interrupt will be maintained accurate to within 0.00005%.

Each time the interrupt counter is reset, a 60-second counter also in RAM 24 will be incremented. When, after resetting the interrupt counter and incrementing the 60-second counter 60 times, a 60-minute counter in RAM 24 is incremented. Similarly, a 24-hour counter and a suitably arranged one-month counter are provided to permit accumulating time-of-day information. As long as power is applied to system 10, time-of-day information will accumulate.

A keyboard 46 is used for manually generating signals for interrogating the counters and for selecting the appropriate display drivers 48 needed to cause a presentation of the counts in the interrogated counter(s) to be displayed on display 50.

A summary of the above-mentioned operations of system 10 will now be presented with the aid of pseudo-code language statements in Table I. Pseudo-code language is a verbal picture of the operations that are generated by the computer programs used within MCU 14, much like a flowchart. In contrast to the flowchart, which is often prepared after the programs are written, pseudo-code is used when designing the program. A coding of the program design into a particular program language is performed after the set of pseudo-code statements are prepared.

Within Table I comment lines are used defined as: /*comment*/. Also, an asterisk (*) and a dash (—), indicating the indentation level of a statement, proceeds each pseudo-code statement. Two dashes of indentation are added whenever a new condition or loop statement is written.

TABLE I

PROCEDURE FOR TIME-OF-DAY FUNDAMENTAL TIME UNIT GENERATION

```
/* Purpose */
/* This procedure is called when the timekeeping mechanism of
```

TABLE I-continued

PROCEDURE FOR TIME-OF-DAY FUNDAMENTAL TIME UNIT GENERATION

```
MCU 14 is to take place so that a software interrupt service
routine is executed which sets up the output compare register
for each interrupt that is executed, the interrupts being
executed about every 1/32 of a second and which increments the
various time-of-day counters as necessary */
/* Definitions */
/* control term: a digital number added to the contents of the
output compare register of the timer system used for
generating a specific period of time */
/* correction term: a digital number added to the contents of
the output compare register for modifying the period of time
established by the control term */
/* correction term = desired frequency - measured frequency
(e.g., 200000 - 1999287)
/* interrupt counter: counts the number of interrupts up to 32
interrupts before being reset
/* 60-second counter: increments one count after the interrupt
counter counts 32 interrupts. The time period between counts
may be expanded or decreased by the correction term in order
to establish an accurate fundamental time unit for the time-
of-day clock */
/* Initial Conditions */
/* prescaled oscillator frequency: measured using a suitable
frequency calibration meter (e.g., 1999287) */
/* free-running counter (FRC): operating at the prescaled
oscillator frequency */
/* output compare register (OCR) contents (initially): any
number */
/* CPU: is set up to allow interrupts */
/* ROM: contains the interrupt service program */
/* all RAM counters = 0 (initially) */
/* interrupt service program: repeatedly executed when OCR =
FRC until power is removed from MCU 14 */
/* - Add 62500 to contents of OCR
/* - Increment interrupt counter
/* - If interrupt counter = 32
/* - - - Then interrupt counter = 0
/* - - - Add correction term to OCR
/* - - - Increment 60-second counter
/* - - - If 60-second counter = 60
/* - - - - - Then 60-second counter = 0
/* - - - - - Increment 60-minute counter
/* - - - - - If 60-minute counter = 60
/* - - - - - - - Then 60-minute counter = 0
/* - - - - - - - Increment 24-hour counter
/* - - - - - - - If 24-hour counter = 24
/* - - - - - - - - - Then 24-hour counter = 0
/* - - - - - - - - - Increment days counter
/* - - - - - - - - - If days counter = days in current month
/* - - - - - - - - - - - Then days counter = 0
/* - - - - - - - - - - - Increment months counter
/* - - - - - - - - - - - If months counter = 12
/* - - - - - - - - - - - - - Then months = 0
End Program
```

TABLE II

| Interrupts | OCR | | | FRC |
|---|---|---|---|---|
| I-1 | | 27181 | 27181 | |
| | | | | 38354 Clk Cycles |
| | Control Term | +62500 | 65535 | |
| | Contents | 89681 | 0 | 1 Clk Cycle (Rollover) |
| | | −65536 | | |
| I-2 | Modulo 65536 equiv | 24145 | | 24145 Clk Cycles |
| | | | | 62500 |
| | " | | " | |
| I-32 | | 1637 | 1637 | |
| | Control Term | 62500 | | 62500 Clk Cycles |
| | Contents | 64137 | 64137 | |
| [RESET: INTERRUPT COUNTER; INCREMENT: 60-SECOND COUNTER] | | | | |
| | | | | 1398 Clk Cycles |
| | Correction Term | +713 | 65535 | |
| | Control Term | +62500 | 0 | 1 Clk Cycle (Rollover) |
| | Contents | 127350 | | |
| | | −65536 | | 61814 Clk Cycles |
| I-33 | Modulo 65536 equiv | 61814 | | 63213 |
| | Control Term | +62500 | 61814 | |
| | Contents | 124314 | 65535 | 3721 Clk Cycles |
| | | | 0 | 1 |
| | | −65536 | | 58778 Clk Cycles |
| I-34 | Modulo 65536 equiv | 58778 | | 62500 |

NOTE:
It should be appreciated by those skilled in the art that the process of subtracting the modulus from the content value is equivalent to dividing by the modulus in this case, since the control term that is added is less than the modulus.

The operation of system 10 will now be described with reference to the pseudo-code statements of Table I, the example calculations shown in Table II and the block diagrams of FIG. 1 and FIG. 2.

To illustrate what occurs during start-up of this system, assume that a 16-bit number having the value of 27181 is present in output compare register 38. It should be appreciated by those skilled in the art that register 38 may contain any number ranging from 0 to 65535. Output compare circuit 40 will compare the number in register 38 with the number of the clock cycles counted by free running counter 36. It should also be appreciated by those skilled in the art that counter 36 provides modulo 65536 counting, hence counter 36 also counts from 0-65535 and then to 0 as does a typical modulo counter. An output compare flag OCF will be set by output compare circuit 40 when a match occurs between the numbers in register 38 (27181) and the count in counter 36. The OCF causes interrupt circuit 44 to generate the initial interrupt signal.

Each interrupt signal is routed to CPU 18. The interrupt signal causes CPU 18 to execute a software interrupt service program. This interrupt service program prepares for the next interrupt by adding the control term (62500) to the contents of the output compare register 38 (27181+62500=89681). But, since modulo arithmetic is being employed, the number 89681 is converted to a modulo value by subtracting 65536 from it (89681−65536) obtaining a modulo number of 24145. This number is the proper value to be stored in compare register 38.

To illustrate how the free-running counter 36 operates, consider the following: realizing that 27181 clock cycles have been counted to obtain a number equivalent to the modulo number stored in the output compare register 38. Since counter 36 also employs modulo arithmetic, 38354 clock cycles of the needed 62500 clock cycles must be counted to cause the counter to reach full capacity of 65535 counts. Then, during roll-over from 65535 back to 0, counter 36 uses up 1 clock cycle of time. Hence, only 24145 further clock cycles must be counted by counter 36 to reach the number 62500. This further counting of 24145 cycles matches the modulo number of 24145 stored in output compare register 38.

The control term is repeatedly added to the contents of the output compare register 38 after each interrupt up to and including interrupt #32. The interrupt counter in RAM 24 is incremented each time the interrupt signal is generated. Hence, after counting 32 interrupts, the interrupt counter in RAM 24 is reset.

Upon resetting the interrupt counter, the 60-second counter also in RAM 24 is incremented.

Then the correction term (+713) is added to the contents of output compare register 38 along with the control term setting the limits on the time interval for the next first interrupt. With the correction term included in the contents of the output compare register, the fundamental unit of time for each second will be accurately developed.

As depicted in Table I, the timekeeping procedure of generating and counting interrupts controlled by the control term and corrected by the correction term will continue indefinitely or until power is removed from system 10. In addition to the 60-second counter, a 60 minute, a day, and a month counter are employed.

This clock oscillator calibration arrangement is capable of adjustments as small as 0.0005%, exceeding the 0.003% specification estabished earlier by a factor of more than 100. Adjustments as large as 3% are also obtainable, easily providing enough adjustment for even worst case crystal oscillators.

I claim:

1. A firmware/hardware time-of-day clock system for deriving a fundamental interval of time from a clock signal of an inherent frequency emanating from an untrimmed crystal oscillator, said fundamental interval of time being used to provide regulated seconds, minutes, hours and months time intervals, said system comprising:

(a) means for continuous counting of the clock cycles of the inherent frequency clock signal from the crystal oscillator;

(b) means for repeatedly indicating when a chosen number of clock cycles of the inherent frequency clock signal has been counted by said clock cycle counting means, said indicating means including means permitting modifying said chosen number of clock cycles to be counted by said clock cycle counting means;

(c) means for generating an interrupt signal each time said chosen number of clock cycles have been counted;

(d) means for counting a predetermined number of interrupt signals generated by said interrupt signal generating means;

(e) first incrementing means for incrementing a 60-second counter upon said counting of said predetermined number of interrupt signals by said interrupt signal counting means;

said first incrementing means including (1) means for resetting said interrupt signal counting means upon incrementing said 60-second counter; and (2) means for adding a predetermined correcting number to said chosen number of clock cycles indicating means for modifying said chosen number of clock cycles of the remaining inherent frequency clock signal to be counted to a value equal to the chosen number plus the correcting number so as to establish a fundamental interval of time.

2. Apparatus in accordance with claim 1 including counter means for counting minutes, hours, days and months in response to accumulations of said fundamental intervals of time.

3. Apparatus in accordance with claim 2 including display means for displaying the value of the count in the contents of said counter means.

4. A firmware/hardware method for deriving a fundamental interval of time from a clock signal of an inherent frequency emanating from an untrimmed crystal oscillator, said fundamental interval of time being used to provide regulated seconds, minutes, hours and months time intervals, said method comprising:

(a) continuous counting of the clock cycles of the inherent frequency clock signal from the crystal oscillator;

(b) repeatedly indicating when a chosen number of clock cycles of the inherent frequency clock signal has been counted generating an interrupt signal each time said chosen number of clock cycles have been counted;

(c) counting a predetermined number of interrupt signals;

(d) incrementing a 60-second counter upon said counting of said predetermined number of interrupt signals;

(e) restarting said interrupt signal counting upon incrementing said 60-second counter;

(f) adding a predetermined correcting number to said chosen number of clock cycles for modifying said chosen number of clock cycles of the remaining inherent frequency clock signal to be counted to a value equal to a chosen number plus the correcting number so as to establish a fundamental interval of time.

5. The method of claim 4 including counting minutes, hours, days and months in response to accumulations of said fundamental intervals of time.

6. The method of claim 4 including the value of the counts of seconds, minutes, hours, days and months derived from the accumulations of said fundamental intervals of time.

* * * * *